United States Patent [19]

Schade

[11] 4,314,539

[45] Feb. 9, 1982

[54] FUEL LINE PRESSURE EQUALIZER FOR INTERNAL COMBUSTION ENGINE

[76] Inventor: Maynard W. Schade, 1238 Beloit Ave., Janesville, Wis. 53545

[21] Appl. No.: 145,768

[22] Filed: Apr. 30, 1980

[51] Int. Cl.[3] ..... F02D 5/02; F02M 59/00; F02M 37/04; F02M 5/10

[52] U.S. Cl. ..... 123/514; 137/115; 137/116.3

[58] Field of Search ..... 123/510, 514; 137/115, 137/116.3

[56] References Cited

U.S. PATENT DOCUMENTS

| | | | |
|---|---|---|---|
| 1,180,826 | 4/1916 | Carson | 123/514 |
| 1,304,550 | 5/1919 | Edison, Jr. | 123/510 |
| 1,849,590 | 3/1932 | Phillips | 123/510 |
| 2,284,709 | 6/1942 | Zoder | 123/510 |
| 3,086,580 | 4/1963 | Capehart | 123/510 |
| 3,240,192 | 3/1966 | Gratzmuller | 123/510 |
| 3,403,664 | 10/1968 | Berchtold et al. | 123/510 |
| 3,674,043 | 7/1972 | Norton | 123/510 |
| 4,044,746 | 8/1977 | Kaye | 123/514 |

*Primary Examiner*—Wendell E. Burns
*Attorney, Agent, or Firm*—Keith Schoff

[57] ABSTRACT

A check valve equipped air vent and fuel pump by-pass member is disposed interconnecting the fuel supply tank of an internal combustion engine with the output of the fuel pump to equalize the pressure of fuel delivered to the carburetor throughout the range of engine speeds.

1 Claim, 3 Drawing Figures

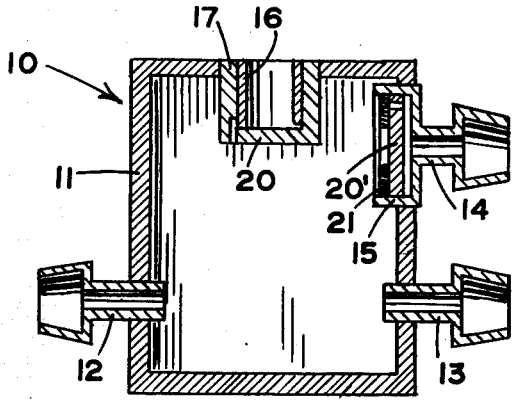
FIG. 1
FIG. 3
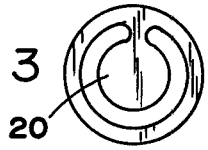
FIG. 2
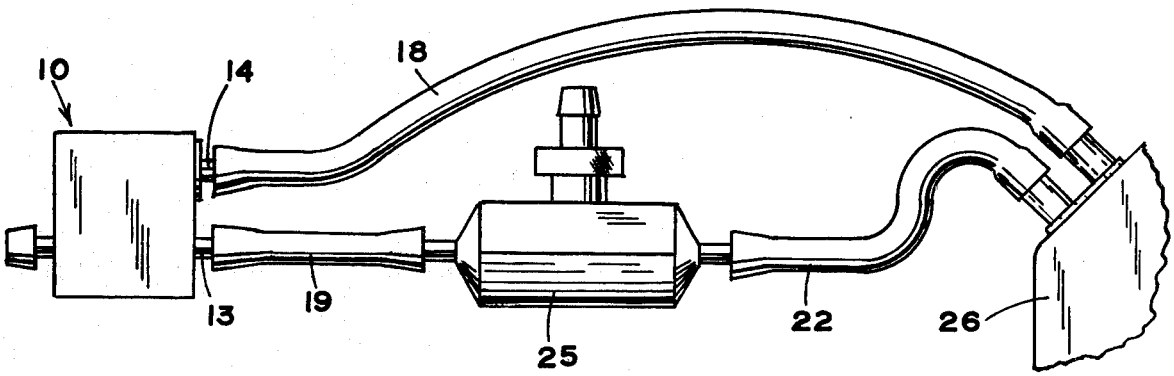

FUEL LINE PRESSURE EQUALIZER FOR INTERNAL COMBUSTION ENGINE

BACKGROUND OF THE INVENTION

Two stroke cycle internal combustion engines conventionally have cylinders ported to the crankcase for receiving a combustible charge, the crankcase on small one cylinder engines such as used in radio controlled model airplanes being valved to admit combustible fuel charge from a carburetor on the upstroke of the piston, with attendance creation of partial vacuum in the crankcase, and to seal the crankcase on the downstroke of the piston thereby increasing pressure in the crankcase and forcing combustible mixture into the cylinder. Cyclic pressure produced in the crankcase may be utilized through means of a crankcase tap to drive a diaphragm pump to supply fuel to the engine carburetor, such means being shown in U.S. Pat. Nos. 3,967,606 and 4,184,811, in conjunction with control devices for regulating pump output to prevent wide variations in fuel pump output from occurring as engine speed varies. For example, a simple diaphragm pump driven by engine crankcase pulsations may deliver fuel to the engine carburetor at a desirable level of six ounces per square inch pressure at engine idle, but provide sixty-four ounces per square inch pressure at full throttle. For ideal engine operation, fuel pressure at the carburetor should be nearly constant throughout the range of engine speeds and operating conditions where non-metered-non-aspirated carburetion is utilized.

SUMMARY OF THE INVENTION

This invention provides a simple and effective method and means for regulating the pressure of the output of a crankcase-pressure-pulse driven diaphragm type fuel pump for an internal combustion engine to within about two ounces per square inch of constancy throughout the range of engine speeds and operating conditions.

Provision is made in the outflow passage of a fuel pump for a chamber through which the pumped fuel passes, with two additional openings being provided in the chamber, one being a vent opening to ambient atmospheric pressure which is equipped with a check valve to prevent egress flow from the chamber, and the other being a passage to a fuel supply tank which is equipped with a check valve to prevent ingress flow to the chamber. Any other vent to the fuel supply tank is sealed. The device operates at engine idle to provide an air vent to the fuel supply tank to compensate for fuel being withdrawn from the supply tank and thereby to maintain constant atmospheric pressure in the tank, while at increased throttle settings in addition to air vented to the fuel supply tank, a quantity of fuel from the fuel pump discharge will also flow back to the fuel supply tank causing the outflow pressure of fuel from the chamber to the engine carburetor to remain relatively constant throughout a range of engine speeds. The device does not require operator attention or involve moving parts other than check valve means, which in a preferred embodiment comprise thin discs of elastomer configured with a partial annulus to define a flap configured with hinge portion contiguous with a concentric encircling ring which may be operably secured in place about an opening to be valved.

BRIEF DESCRIPTION OF THE DRAWINGS

FIG. 1 is a side elevation in section of an embodiment of the invention;

FIG. 2 is a schematic view of the device of FIG. 1 operably connected for use to a fuel supply tank and a fuel pump;

FIG. 3 is a plan view of a check valve shown in FIG. 1.

DESCRIPTION OF THE PREFERRED EMBODIMENT

Referring to FIG. 1 pressure equalizer 10 is shown with case 11 enclosing chamber 9. Metal nipples 12 and 13 for receiving tubing are oppositely disposed and aligned for unimpeded flow of fuel such as gasoline from a fuel pump, such as pump 25 shown in FIG. 2, to a carburetor, not shown. Nipples 12 and 13 offer substantially no resriction to flow between fuel pump and carburetor. In the top of case 11 check valve 20 operably affixed in tubular throated metal mounting 16 is shown with the mounting being secured in the opening by means of resinous press-fitted sleeve 17. Check valve 20 is configured in plan view as shown in FIG. 3 with a partial annular opening 28 disposed between central flap 27 and outer concentric ring 29 with the latter portions connected by contiguous hinge portion 31. Check valve 20 operably seals against a lower face of mounting 16 in response to a pressure differential between atmospheric pressure external to equalizer 10 and super-atmospheric pressure within chamber 9, and conversely opens to vent chamber 9 to atmospheric pressure when pressure within the chamber is sub-atmospheric. Nipple 14 is similar to nipples 12 and 13, but is fitted with check valve 20' similar to check valve 20, but mounted to open and vent chamber 9 when pressure within the chamber is greater than the pressure external to equalizer 10, i.e. within fuel tank 26 as shown in FIG. 2 when equlizer 10 is operably installed in the fuel delivery system of an internal combustion engine. Conversely, check valve 20' will seal chamber 9 against flow from fuel supply tank 26 of FIG. 2 in response to a pressure differential exisiting between the tank and the chamber.

Nipples 12, 13, and 14 are shown press-fitted into case 11, but may be threaded, soldered or otherwise affixed in any operable manner. In a preferred embodiment the nipples and case 11 comprise aluminum and the check valves a chlorinated synthetic rubber material which resist attack by gasoline.

As shown in FIG. 2 equalizer 10 is operably communicated with fuel supply tank 26 by flexible chlorinated rubber tube 18 so as to vent tank 26 near the top through nipple 14 and chamber 9 to atmosphere when check valve 20 is open. Equalizer 10 is further communicated by nipple 13 and tube 19 to the discharge port of fuel pump 25 with the inlet port of fuel pump 25 being communicated to tank 26 by tube 22. Fuel pump 25 is a diaphragm type pump driven by crankcase pulsations and may be a pump as described in U.S. Pat. No. 4,184,811. Outflow nipple 12 from equalizer 10 can be provided with a tube connection to communicated to the fuel supply port of the carburetor of an internal combustion engine.

In operation, an engine which typically would be a fractional cubic inch displacement single cylinder two stroke cycle model airplane engine, may be primed and started whereupon pressure pulsations from the engine crankcase drive tubular-diaphragm fuel pump 25 in operable manner with pulsated flow of fuel being discharged to chamber 9 of equalizer 10 thereby introducing positive pressure into chamber 9 while simultaneously sub-atmospheric pressure occurs in tank 26 by gasoline being pumped therefrom and causes check valve 20' to open. Air from chamber 9 flows to tank 26 equalizing the pressure in the two enclosed volumes, however, at least some of the gasoline in chamber 9 flows from the chamber through nipple 12 to the engine carburetor causing the equalized pressure in the two enclosed volumes to be sub-atmospheric with the result that check valve 20 opens and vents chamber 9 to atmosphere and such pressure is communicated to tank 26. Regardless of the delivery rate from pump 25 to chamber 9, there will always be required inflow of atmospheric air sufficient to compensate for the volumetric flow of gasoline through nipple 12 to the engine carburetor and thus pressure within chamber 9 will remain substantially constant, i.e. pressure within the chamber would be atmospheric except for pressure loss because of fluid flow frictional loss and a constant attributable to resilient restoring force and momentum of the valve means. In practice check valve 20' passes a mixture of gasoline returned to the fuel tank and air to displace gasoline exhausted through nipple 12 to the engine carburetor, and pulsations in the delivery of gasoline to chamber 9 through nipple 13 from fuel pump 25 are transmitted through nipple 12 thus providing in some degree a dynamic component to head pressure of fuel delivered to the carburetor, but that component becomes nearly constant in magnitude as the proportion of gasoline returned to the fuel tank increases with increasing rate of delivery of gasoline by the fuel pump to chamber 9.

While check valve 20' is described herein for use in the return line to the fuel tank, elimination of check valve 20' will not hinder operation, however the presence of check valve 20' insures against flow from the fuel tank directly to pressure equalizer 10.

I claim:

1. Pressure regulating and venting apparatus for an internal combustion engine fuel system comprising an enclosed chamber communicated by an input passage disposed to received delivery of fuel from a fuel pump, and further communicated by a fuel outflow passage disposed to deliver fuel to a carburetor, and further communicated by a fuel return passage disposed to provide for flow of fluid to a fuel supply source, said chamber being further provided with an atmospheric vent equipped with a check valve to enable air to enter said chamber to maintain at least atmospheric pressure therein, said apparatus effecting near constant fuel pressure at said output passage.

* * * * *